United States Patent [19]

Kasahara et al.

[11] Patent Number: 4,862,214

[45] Date of Patent: Aug. 29, 1989

[54] IMAGE FORMING APPARATUS

[75] Inventors: Nobuo Kasahara; Tosio Nakahara, both of Yokohama, Japan

[73] Assignee: Ricoh Company, Ltd., Tokyo, Japan

[21] Appl. No.: 163,084

[22] Filed: Mar. 2, 1988

[30] Foreign Application Priority Data

Mar. 2, 1987 [JP] Japan ..... 62-46994

[51] Int. Cl.[4] ..... G03G 15/00; G03G 15/14

[52] U.S. Cl. ..... 355/377; 355/3 SH

[58] Field of Search ..... 355/3 TR, 3 R, 3 DR, 355/14 TR, 16, 3 SH, 14 SH

[56] References Cited

U.S. PATENT DOCUMENTS

| | | | |
|---|---|---|---|
| 4,338,017 | 7/1982 | Nishikawa | 355/3 TR |
| 4,370,051 | 1/1983 | Matsuyama et al. | 355/3 R |
| 4,411,511 | 10/1983 | Ariyama et al. | 355/3 TR |
| 4,537,493 | 8/1985 | Russel | 355/3 SH |
| 4,550,999 | 11/1985 | Anderson | 355/3 TR |
| 4,739,361 | 4/1988 | Roy et al. | 355/3 TR |
| 4,740,813 | 4/1988 | Roy | 355/3 DR |

*Primary Examiner*—A. C. Prescott

*Attorney, Agent, or Firm*—Oblon, Spivak, McClelland, Maier & Neustadt

[57] ABSTRACT

In an arrangement of a photoconductive drum and a transfer drum which are installed in a color image forming apparatus, the rotation speed of the transfer drum is increased during the interval between consecutive image transfers so as to increase the recording speed. The photoconductive and transfer drums are each rotatable about a shaft driven independently of the other. A photoconductive drum and a dielectric sheet are wrapped around the photoconductive drum and the transfer drum, respectively. The transfer drum is constituted by a hollow cylindrical frame which is made up of two rotatable rings and a connecting portion which interconnects the two rings. The rings and connecting portion cooperate to define an intermediate opening, and the dielectric sheet is positioned to close the intermediate opening. The axial width of the photoconductive drum is smaller than that of the intermediate opening. In opposite end portions of the photoconductive drum where the photoconductive material is absent, positioning disks are provided each making direct rolling contact with a portion of a respective one of the rotatable rings where the dielectric sheet is absent.

35 Claims, 6 Drawing Sheets

IMAGE FORMING APPARATUS

BACKGROUND OF THE INVENTION

The present invention relates to a device for positioning two movable bodies which are driven independently of each other and, more particularly, to a device for positioning two rotary bodies. Further, the present invention is concerned with an image forming apparatus of the type having photoconduction means and transfer means which are each implemented with a drum or belt and are driven independently of each other to be individually rotatable at variable speeds, and in which the rotation of the transfer drum relative to that of the photoconductive drum is accelerated during the interval between consecutive image transfers in matching relation to a size of paper sheets so as to increase the recording speed, particularly in a color copier or like color image forming apparatus capable of reducing a period of time necessary for copying.

It has been customary to adopt an arrangement wherein a color original document is repetitively scanned by optics which includes a plurality of color separating filters while, at the same time, exposure by a plurality of separated color components are sequentially effected. The resulting latent image formed on a photoconductive drum or other photoconduction means, are individually developed by toner or complementary colors which are supplied by a developing device, and the resulting toner images are sequentially transferred to a paper sheet which is clamped on the transfer drum, or other transfer means, which is in turn held in contact with the photoconductive drum. The photoconductive drum and the transfer drum are interconnected by, for example, gears so as to be driven together at a constant speed. The circumferential dimension of the transfer drum is at least approximately the same as the length of the largest paper size usable with the copier, e.g. size A3. Hence, in the case that a toner image is transferred to a paper sheet of size A3 by way of example, the transfer drum has to be wastefully rotated by one rotation while the optics scans back, resulting in the transfer taking approximately twice as long a period of time as in the case of transfer of a toner image to paper sheets of sized B4 and A4.

A color copier designed to eliminate the above drawback is disclosed in, for example, Japanese Laid-Open Patent Publication (Kokai) No. 60-218673 (Fuji Xerox). In the color copier there disclosed, the optics scans and scans back on a color component basis in matching relation to a paper size, and the rotation speed of a transfer drum is varied during the interval between consecutive transfers and based on the paper size so that the leading end of the next toner image of a particular color and that of a paper sheet may coincide with each other at a predetermined transfer position. That is, a particular copying speed is set up which matched with a particular paper size. To so vary the speed of the transfer drum, the transfer drum and the photoconductive drum are driven by individual drive sources (servo motors). The transfer and photoconductive drums are dimensioned substantially equal to each other in their axial direction and held in direct contact with each other under a predetermined pressure. Although not clearly shown or described in said laid-open publication, a transfer drum of the above-described type of prior art color copier has a rotatable drum which is notched along its axis to form an intermediate opening.

The intermediate opening is delimited at opposite axial ends thereof by end portions of the drum. A dielectric sheet such as a dielectric film or an electrostatic screen is wrapped around the end portions of the drum. With this configuration, the opposite end portions of the transfer drum make contact with the photoconductive surface of the photoconductive drum with the intermediary of the dielectric sheet.

With the above construction, however, it is almost impracticable to set up a copying time appropriate for a particular paper size by varying the rotation speed of the transfer drum relative to that of photoconductive drum, as stated earlier. Specifically, since the photoconductive and transfer drums press against each other via the dielectric sheet at opposite ends thereof, the frictional force acting between the two drums when the speed of the transfer drum is changed is too great to permit smooth slippage of the drums. Any excessive force would result in vibrations and, therefore, in blurring, jitter and various other causes of incomplete image reproduction.

Further, even if the speed of the transfer drum is not changed, the dielectric sheet is pressed by a substantial transfer pressure by the opposite end portions of the transfer drum, which is rigid, making rolling contact with the photoconductive drum. This brings about some other problems as follows. Both the transfer and photoconductive drums have to be machined with considerable accuracy at the sacrifice of cost. Rolled by the high transfer pressure, the dielectric sheet is deformed at opposite end portions of the two drums resulting that a toner image is prevented from being uniformly transferred to a paper sheet. In addition, toner, paper dust and other particles are apt to deposite on the opposite end portions of the two drums, disturbing uniform transfer of a toner image.

SUMMARY OF THE INVENTION

It is, therefore, an object of the present invention to provide a device for positioning two movable bodies which are movable relative to each other driven independently of each other.

It is another object of the present invention to provide a device for positioning two rotatable bodies which are rotatable relative to each other driven independently of each other.

It is another object of the present invention to provide a color image forming apparatus capable of transferring a toner image with a minimum of irregularity.

It is another object of the present invention to provide a color image forming apparatus capable of enhancing the durability and reliability of transfer means thereof.

In accordance with the present invention, a device for positioning relative to each other a first and a second body which are movable driven independently of each other comprises a base constituting the first body, a first contact surface member provided on a part of the base, a frame constituting the second body and having an opening formed therethrough, and a second contact surface member provided on and supported by a part of the frame and closing the opening, the second contact surface member making contact with the first contact surface member. The first contact surface member has a width in a direction perpendicular to an intended direction of movement of the first body which is smaller than a width of the opening of the frame in a direction perpendicular to an intended direction of movement of the second body.

BRIEF DESCRIPTION OF THE DRAWINGS

The above and other objects, features and advantages of the present invention will become more apparent from the following detailed description when taken with the accompanying drawings in which.

DESCRIPTION OF THE PREFERRED EMBODIMENTS

Figure 1:
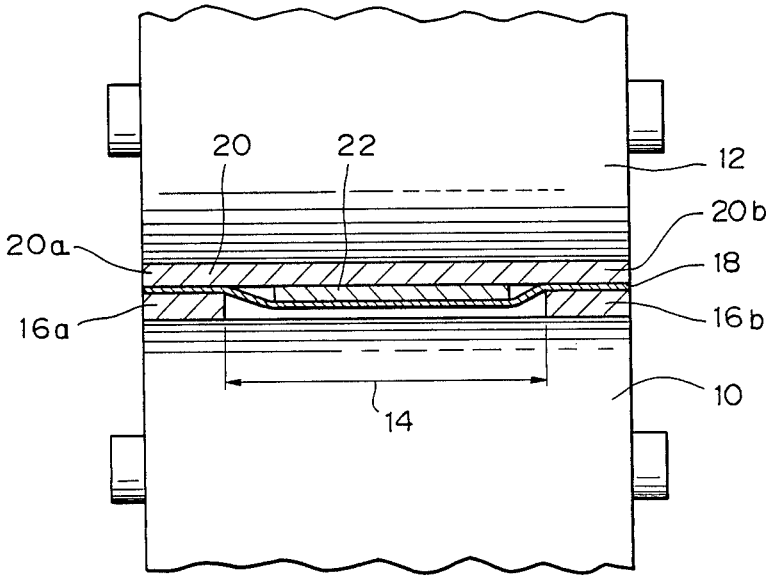
Fig. 1 PRIOR ART
FIG. 1 is a view showing the arrangement of a photoconductive drum and a transfer drum which are installed in a prior art color copier.

To better understand the present invention, a brief reference will be made to a photoconductive drum and a transfer drum which are included in a prior art color image forming apparatus, shown FIG. 1. As shown, the image forming apparatus, e.g., a color copier includes a transfer drum 10 and a photoconductive drum 12 which have substantially the same in dimension as measured in the axial direction of the drums. The drums 10 and 12 are directly pressed against each other by a predetermined pressure necessary for image transfer and driven together through gears. The transfer drum 10 is provided with a notch-like intermediate opening 14 which extends along the axis of the drum 10. Circumferential surface portions 16*a* and 16*b* of the drum 10 which are defined on opposite sides of the intermediate opening 14 are held in pressing contact with a photoconductive material of the photoconductive drum 20 via a dielectric sheet 18. The dielectric sheet 18 is formed as a dielectric film or an electrostatic screen is wrapped around the transfer drum 10. With this kind of construction, it is substantially impossible to increase the rotation speed of the transfer drum 10 relative to that of the photoconductive drum 12 after the tail end of a paper sheet 22 has moved past the drum 10, so as to shorten the period of time necessary for copying. Specifically, while the rotation speed of the drum 10 has to be variable in order to set up a paper linear velocity most efficient for particular copying conditions, the construction of FIG. 1 suffers from the imposition of a great frictional force due to the pressing contact of the axially opposite end portions 16*a* and 16*b* of the transfer drum 10 and ends 20*a* and 20*b* of the photoconductive material 20 of the photoconductive drum 12 via the dielectric sheet 18. Such a frictional force obstructs the smooth slippage which must occur in the event of a speed change of the transfer drum 10. Should an excessive force be applied to the transfer drum 10, there would occur vibrations which bring about various causes of incomplete reproduction of images, e.g. blurring and jitter. Even if the rotation speed of the transfer drum 10 is not varied, the above construction gives rise to various other problems due to the dielectric sheet 18 making rolling contact with the drums 10 and 12 while being compressed by the substantial pressure at opposite end portions of the rigid drums 10 and 12, as follows:

(1) The drums 10 and 12 have to be machined with considerable accuracy at the sacrifice of cost;

(2) The dielectric sheet 18 is rolled by the high transfer pressure and is deformed at the opposite end portions of the drums 10 and 12, preventing a toner image from being uniformly transferred to the paper sheet 22; and (3) Paper dust, toner carrier and other particles are apt to deposit on opposite end portions of the drums 10 and 12, resulting in the same trouble as the above trouble (2).

A preferred embodiment of the present invention which is free from the problems discussed above will now be described in detail. In the following description, let the image forming apparatus be a color copier for the convenience of description.

Figure 2:
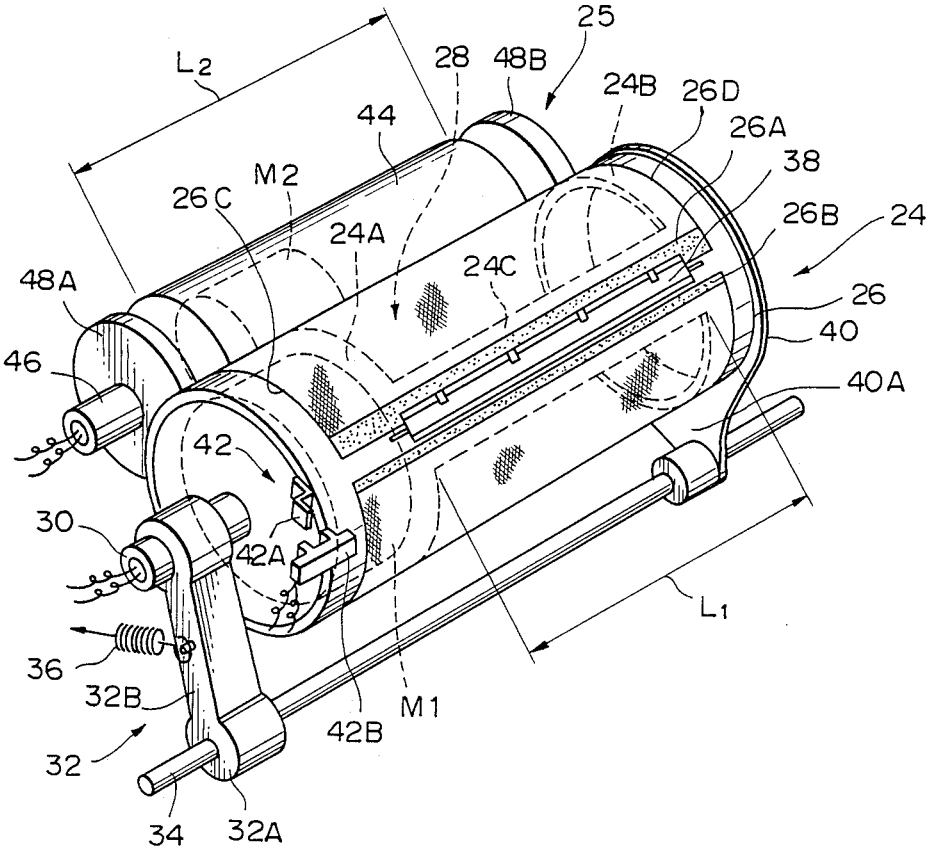
FIG. 2 is a perspective view showing the arrangement of a photoconductive drum and a transfer drum in accordance with a preferred embodiment of the present invention.
Figure 3:
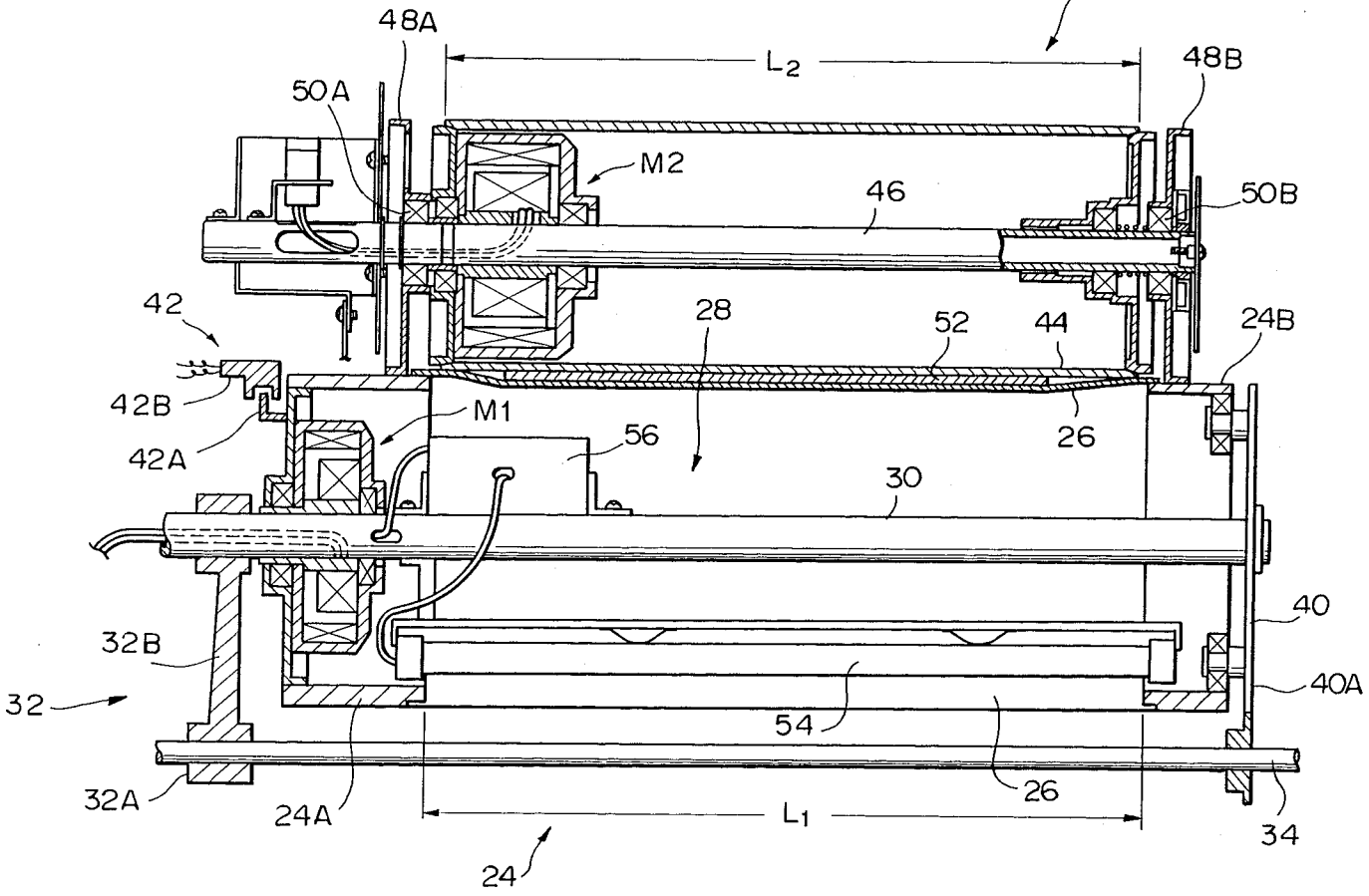
FIG. 3 is a section showing a relationship between the two drums of FIG. 2.

Referring to FIGS. 2 and 3, a color copier includes a transfer drum, or exemplary transfer means, 24 and a photoconductive drum 25, or exemplary photoconduction means. The transfer drum 24 which has a hollow cylindrical frame-like configuration is constituted by two rings 24A and 24B which are located coaxially with and at spaced locations from each other, and a connecting portion 24C which extends parallel to the axis of the drum 24 to interconnect the rings 24A and 24B. A dielectric sheet 26 is implemented with a flexible member and wrapped around the transfer drum 24 by using the circumferential surfaces of the rings 24A and 24B. Opposite ends 26A and 26B only of the dielectric sheet 26 are individually fixed to the connecting portion 24C by adhesive, hooks or similar suitable fixing means. Opposite side edges 26C and 26D of the dielectric sheet 26 are not fixed to the rings 24A and 24B. The transfer drum 24 is void of a wall between the rings 24A and 24B, defining an intermediate opening 28 therein. The dimension of the intermediate opening 28 as measured in the axial direction of the transfer drum 24 is $L_1$. The transfer drum 24 is supported by a hollow shaft 30. An outer rotor type motor $M_1$ is disposed in the transfer drum 24 to drive the outer peripheral portion of the drum 24 in a rotary motion relative to the shaft 30. One end of the shaft 30 is rotatably connected to one end of an arm 32, the other end of which is in turn rotatably connected to a stationary shaft 34. A tension spring 36 is anchored to an intermediate portion 32B of the arm 32 so that a predetermined transfer pressure is applied from the transfer drum 24 to the photoconductive drum 25. A sheet gripper 38 for gripping the leading end of a paper sheet is provided on the connecting portion 24C of the transfer drum 24. The other end of the shaft 30 is fixedly connected to a face plate 40 while the outer peripheral portion of the transfer drum 24 is journalled to the face plate 40 (see FIG. 3). A base portion 40A of the face plate 40 is rotatably connected to the stationary shaft 34. A member 42A to be sensed is fixed to one end portion of the transfer drum 24 while a sensor 42B is fixed to an unmovable member, not shown, and located in a path along which the member 42A is movable. Constituted by a light emitting element and a light-sensitive element, for example, the sensor 42B cooperates with the member 42A to constitute a home position sensor for sensing a home position of the transfer drum 24.

The photoconductive drum 25 which is a rigid member includes a photoconductive material 44 which is wrapped around the drum 26. The drum 25 itself is rotatably mounted on a hollow stationary shaft 46. An outer rotor type motor $M_2$ is disposed in the drum 25 to drive the latter with a rotary motion. Labeled $L_2$ is the width of the photoconductive drum 25, more particularly the width of the photoconductive material 44. In the illustrative embodiment, the width $L_2$ of the photoconductive drum 25 is smaller than that $L_1$ of the intermediate opening 28 of the transfer drum 24.

Positioning disks 48A and 48B each in the form of a rotatable ring are positioned at axially opposite end portions of the photoconductive drum 25 and are rotatable relative to the shaft 46 through bearings 50A and 50B, respectively (FIG. 3). The positioning disks 48A and 48B are respectively pressed against those portions of the rings 24A and 24B of the transfer drum 24 in which the dielectric sheet 26 is absent, whereby the drums 24 and 25 are spaced apart from each other by a predetermined distance which allows the dielectric sheet 26 and the photoconductive material 44 to make light contact with each other.

In the above construction, the transfer pressure is developed between the transfer drum 24 and the photoconductive drum 25 by way of the positioning disks 48A and 48B which are free to rotate relative to the shaft 46. This, coupled with the fact that the width $L_2$ of the photoconductive material 44 is smaller than that $L_1$ of the intermediate opening 28 of the transfer drum 24, causes the photoconductive material 44 and the dielectric sheet 26 to slip smoothly on each other even when the rotation speed of the drum 24 is changed relative to that of the drum 25. Hence, the image reproduction is free from blurring, jitter and other undesirable occurrences. Since the positioning disks 48A and 48B are pressed against the transfer drum 24 while avoiding the dielectric sheet 26, the dielectric sheet 26 is prevented from being deformed or rolled even after a long period of use, insuring reliability of operation as well as durability. Furthermore, the dimensional accuracy required for the framework of the transfer drum 24, and, therefore, the cost is cut down as compared to the conventional design.

In this particular embodiment, a paper sheet 52 is positioned between the photoconductive material 44 and the dielectric sheet 26 which yields into the intermediate opening 28. This promotes uniform transfer of a toner image and increases the transfer efficiency. Implemented with a flexible film of polyester, 4-vinylidene flouride or like material, the dielectric sheet 26 is capable of uniformly pressing on even relatively thin paper sheets due to its elasticity, thereby insuring image transfer. Since the photoconductive material 44 is not directly pressed by the transfer drum 24 and since the dielectric sheet 26 is not directly pressed by the disks 48A and 48B, there is eliminated the deposition of toner, paper dust and other particles which would otherwise damage the materials 44 and 26 and/or affect the image transfer.

In FIG. 3, the reference numeral 54 designates a separating charger which is powered by a power pack 56 that is mounted on the shaft 30. The hollow shafts 30 and 46 are individually used to accommodate the leads adapted for the drive of the motors $M_1$ and $M_2$ therein.

Figure 4:
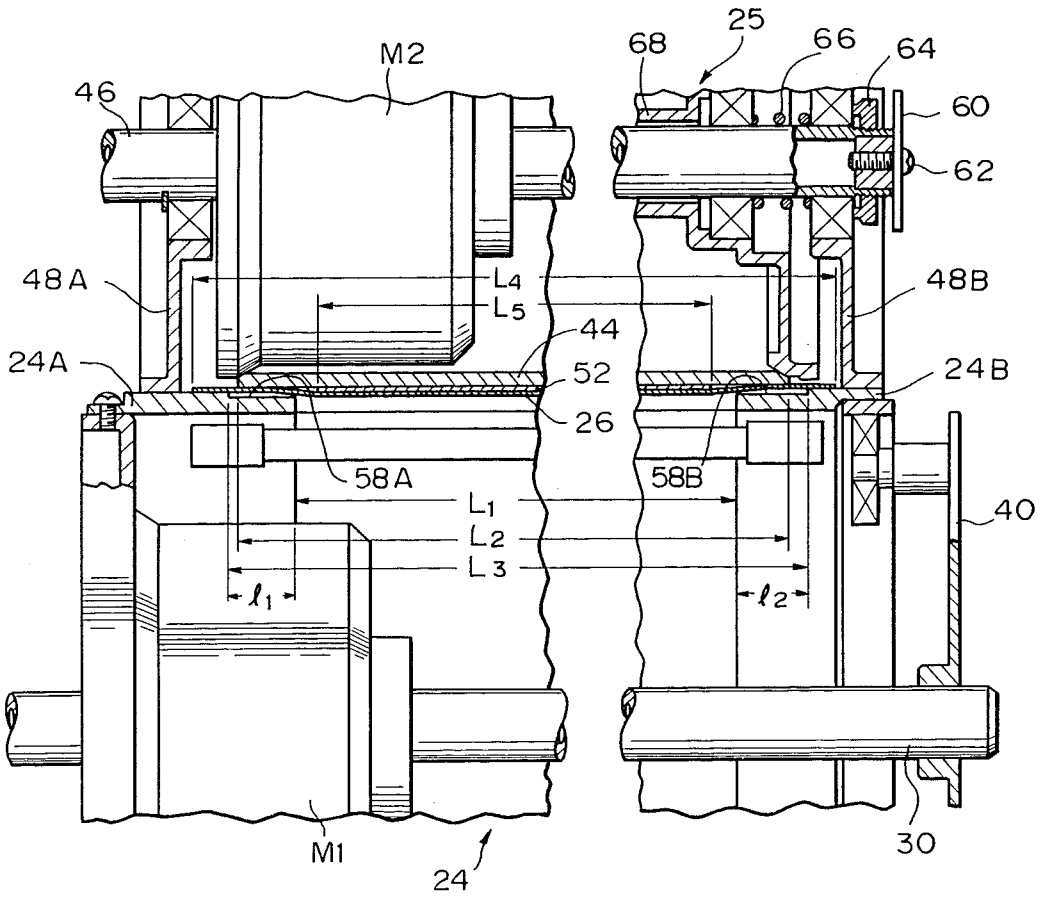
FIG. 4 is an enlarged section representative of a modification to the embodiment of FIG. 2.

Referring to FIG. 4, a modification to the above-described embodiment is shown in a fragmentary enlarged view. As shown, the rings 24A and 24B of the transfer drum 24 are provided with, respectively, stepped portions 58A and 58B, each allowing the dielectric sheet 26 to yield thereinto. The sum of the widthwise dimension $L_1$ of the intermediate opening 28 and dimensions $l_1$ and $l_2$ of the stepped portions 58A and 58B, respectively, is assumed to be $L_3$. In this case, the total dimension including those of the stepped portions 58A and 58B is the width of the transfer means and substantially constitutes a region into which the dielectric sheet 26 can yield. Hence, the width $L_2$ of the photoconductive drum 25 does not have to be smaller than that $L_1$ of the intermediate opening 28, i.e., the width $L_2$ need only be smaller than the dimension $L_3$ which includes the stepped portions 58A and 58B. In this modification, the width $L_4$ of the dielectric sheet 26 is smaller than the distance between the positioning disks 48A and 48B and, therefore, the disks 48A and 48B are not pressed against the dielectric sheet 26. The dimension of the paper sheet 52 is indicated by $L_5$ and is smaller than the dimension $L_1$ of the intermediate opening 28.

To summarize the above embodiment and modification thereto, the positioning disks 48A and 48B make contact with the transfer drum 24 at those positions outward of the side edges of the dielectric sheet 26, which is wrapped around the framework of the transfer drum 24 that is constituted by the rings 24A and 24B, with respect to a thrusting direction, i.e. at those positions where the disks 48A and 48B do not make direct contact with the dielectric sheet 26. Preferably, the diameter of those portions of the rings 24A and 24B which are pressed against the positioning disks 48A and 48B, respectively, is larger (by: (minimum thickness of paper sheet 52+thickness of dielectric sheet 26)×2) than the outside diameter of the transfer region (having width $L_3$) of the transfer drum 24, which is defined in the intermediate part of the drum 24, under a non-transfer condition. This allows a toner image to be uniformly transferred to the paper sheet 25 while protecting the dielectric sheet 26 against damage.

As stated above, the transfer drum 24 is rotatable not only at the same speed as the drum 25 but also in a skipping fashion, i.e., it can be accelerated and decelerated during rotation in order to increase the copying speed in matching relation to the size the paper sheet 52. During such skip rotation, although the drums 24 and 25 slip on each other in the transfer region, the slip does not entail any substantial change in load because the dielectric sheet 26 is flexible, as previously mentioned. Hence, despite the slip, the drums 24 and 25 each undergo a minimum of jerkiness during change in speed. This eliminates blurring during image transfer, rubbing of an image, local omission of an image, jitter and other image defects which would result in an incomplete image, as well as troubles in sequence control. Further, the power loss of the drive motors $M_1$ and $M_2$ which are associated with the drums 24 and 25, respectively, is only negligible so that energy is saved. In addition, toner, paper dust and other particles deposited on the photoconductive element 44 have little effect on the transfer of a toner image while, at the same time, the element 44 is freed from firm adhesion of toner, separation of the photoconductive material from the drum base member, and other causes of damage.

The positioning disk 48B is readily detachable from the shaft 46 and, as shown in FIG. 4, accurately positioned when attached to the shaft 46. Specifically, the drum 25 is removed by loosening a screw 62, then removing a face plate 60, then removing a thrust ring 64, and then removing a compression spring 66 and a front retainer flange 68. Such a simple procedure facilitates maintenance in the event of replacement of the drum 25. Since the drum 25 and the positioning disks 48A and 48B are coaxial with each other, the disks 48A and 48B can be accurately positioned relative to the drum 25. The accuracy with respect to the transfer position is easily attainable without resorting to any special adjustment. The dielectric sheet 26 suffers from only a minimum of interference and, therefore, is durable and reliable.

Figure 5:
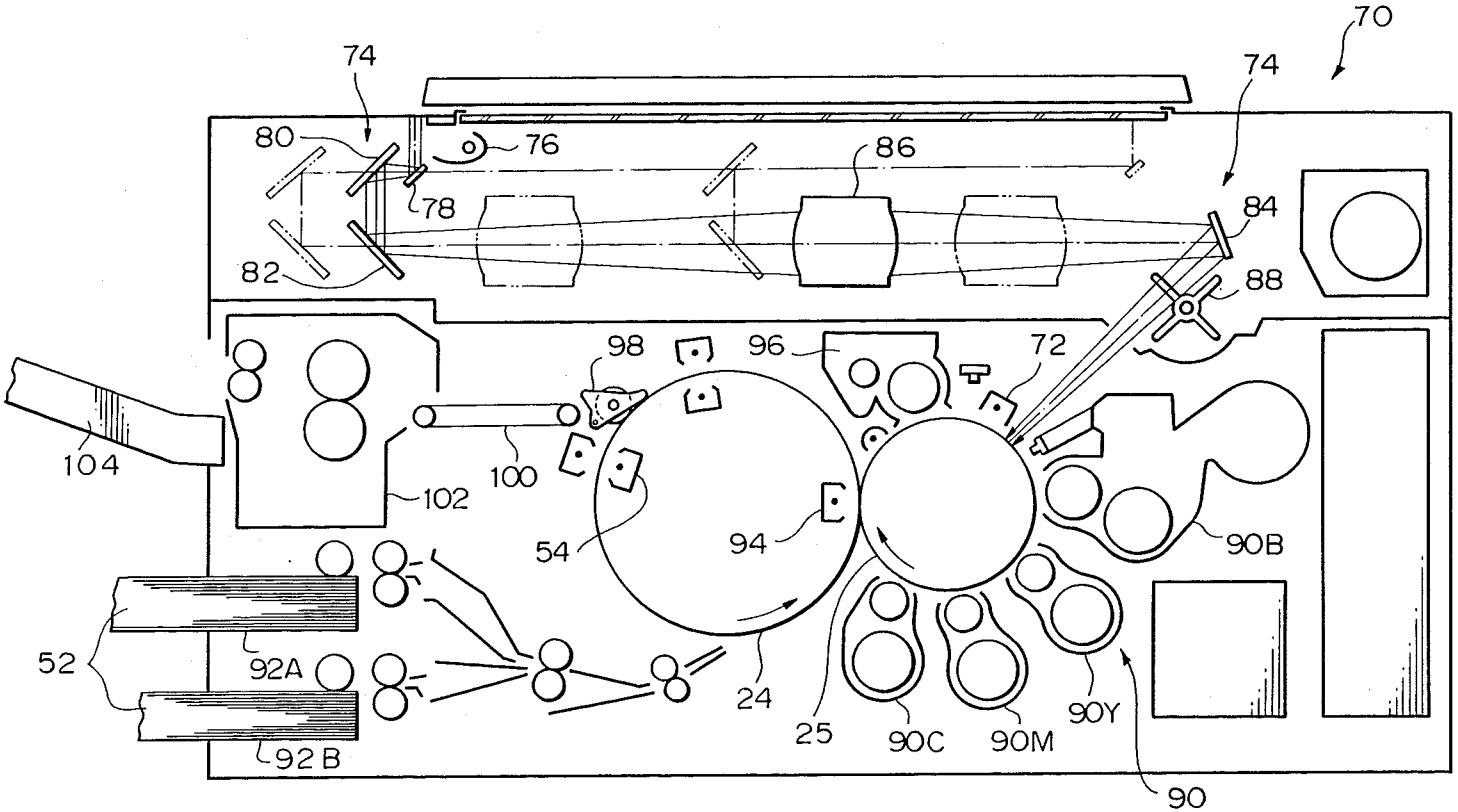
FIG. 5 shows an example of a color copier to which the present invention is applied.

Referring to FIG. 5, an exemplary color copier to which the embodiment and modification described above are applicable is shown and generally designated by the reference numeral 70. As shown, the copier 70 includes a charger 72 located in the vicinity of the drum 25, and scanning optics 74 located next to the charger 72. As well known in the art, the optics 74 includes a lamp 76, a plurality of mirrors 78, 80, 82 and 84, and a lens 86. The optics 74 performs a scanning stroke from a home position indicated by a solid line in the figure to a position which is indicated by a dash-and-dot line in the figure, i.e. over a distance which is associated with the length of a document or magnification selected. From the dash-and-dot line position to the solid line position, the optics 74 performs a return stroke. A color separating filter 88 is disposed in an optical path which is defined by the optics 74. Located next to a position at which a light image is focused by the optics 74 is a developing device 90. The developing device 90 includes a magenta (M) developing unit 90M, a cyan (C) developing unit 90C and a yellow (Y) developing unit 90Y which are adapted for color copying, and a black (B) developing unit 90B. A hollow transfer drum 24 rotatable with the paper sheet 52 held thereon is disposed after the developing device 90. Specifically, the transfer drum 24 clamps the paper sheet 52 which is fed from any of a plurality of paper cassettes 92A and 92B and carries it for a plurality of cycles of image transfer. Disposed in the hollow transfer drum 24 is a transfer charger 94. The reference numeral 96 designates a cleaning device which is located next to the transfer drum 24.

Basically, the copier 70 having the above construction is operated as follows. The optics 74 repetitively scans a color original document so that the single drum 26 which is rotating at a predetermined speed is sequentially exposed to a plurality of color components of light. Latent images produced on the drum 25 by such exposure are sequentially developed by the developing device 90 which supplies toner of complementary colors. The resulting toner images are sequentially transferred to the paper sheet 52 which is clamped and rotated by the transfer drum 24, whereby a complete color copy is produced. The paper sheet 52 carrying the complete color image thereon is separated from the transfer drum 24 by a separator pawl 98, then transported by a belt 100 to a fixing device 102, and then driven to a tray 104.

In the color copier 70, the linear velocity of the drum 25 is changed depending upon a mode which is selected by an operating switch, not shown, i.e. a color mode or a black-and-white mode (or monocolor mode). An experimental model was found operable with a linear speed of 2 in the black-and-white mode for a linear speed of 1 in the color mode, meaning that twice the processing ability is attainable in the black-and-white copy mode. In this condition, the individual elements are controlled in speed and position in matching relation to the change in the linear speed of the drum 25.

Another capability achievable with the color copier 70 is combination copying, e.g., it is capable of copying in combination a color image and a monocolor image of a plurality of documents on the same paper sheet. Specifically, in a combination copy mode, a color image of a first document is produced first. At this instant, the paper sheet 52 is retained on the transfer drum 24 and, after the transfer of the color image, held stationary. This position of the paper sheet 52 which is halted is stored in a central processing unit (CPU) of the copier 70, so that in the event of the transfer of a monocolor image the leading end of the image and the paper sheet are synchronized to each other for producing a combined copy. No doubt, such a combination of images is only illustrative and may be replaced with any other desired one. Further, positions of images to be combined on the same paper sheet may be specified by entering the position data on an operation board and driving the transfer drum 24 in a particular range specified.

While the motors M1 and M2, FIG. 3, are operatively connected to, respectively, the photoconductive drum 25 and the transfer drum 24, an independent motor is operatively connected to the optics 74. The motor associated with the optics 70 is reversible in order to implement the reciprocal motion of the optics 70. A scanning sensor is provided for sensing the position (home position) of the lamp 76 and other elements of the optics 74 before the start of a scanning stroke, i.e., the scanning start position of the optics 74 as represented by a solid line in the figure. A paper sheet sensor is located in the vicinity of the transfer drum 24 to sense the trailing end of the paper sheet 52 which is loaded on the transfer drum 24. A control system includes a reference pulse generator for generating reference pulses which are adapted to drive the motor M2 at a predetermined speed, servo circuits for individually controlling the speed of the motor M1 and that of the scanning motor based on the speed of the motor M2, and a circuit for delivering a paper size indication to the servo circuits. The control system is disclosed in detail in pending U.S. patent application Ser. No. 012,492 filed Feb. 9, 1987.

In the above construction, the transfer start timing and the transfer end timing are detected on the basis of an output signal of the scanning sensor and that of the paper sheet sensor. The rotation speed of the transfer drum 24 is controlled during the interval between the transfer end timing and the transfer start timing detected, so that the leading end of the paper sheet 52 on the transfer drum 24 and that of any of the toner images on the photoconductive drum 25 may coincide with each other. Specifically, it is not that the scanning, or exposure, begins at the same position for all the images of different colors awaiting the end of one full rotation of the photoconductive drum 25 each time, but that immediately after a return stroke of the optics 74 the next scanning begins to expose the drum 25 imagewise. As a result, the scanning stroke is reduced with the paper size. In this instance, the rotation speed of the transfer drum 24 is controlled independently of that of the photoconductive drum 25 in order to eliminate misalignment during image transfer.

In summary, it will be seen that in any of the embodiment and modification described above the width of a photoconductive material of a photoconductive drum is selected to be smaller than that of an intermediate opening of a transfer drum (or of the intermediate opening plus stepped portions) so that, even if the rotation speed of the transfer drum is changed, vibrations due to friction which would affect the quality of image reproduction does not occur. Hence, uniform image transfer is completed with a minimum of irregularity within a short period of time and, yet, the transfer efficiency is enhanced while, at the same time, the durability and reliability of the transfer drum are increased.

Figure 6:
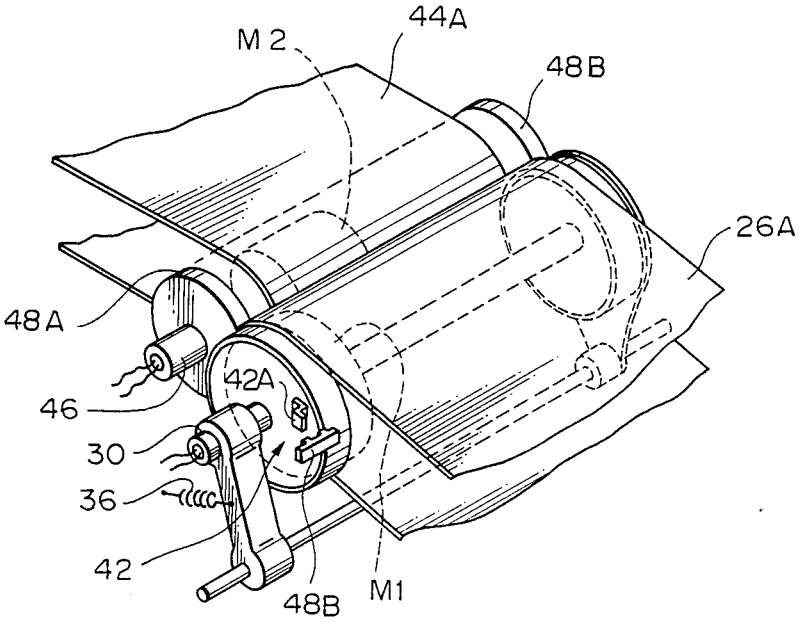
FIG. 6 is a perspective view showing the arrangement of an endless photoconductive belt and an endless dielectric sheet in accordance with a modification to the embodiment of FIG. 2.

Of course, the present invention is applicable not only to photoconduction means and transfer means which constitute a color copier and other image forming equipment as shown and described but also to any apparatus which positions at least two movable bodies such as belts or two rotary bodies such as drums relative to each other by controlling their relative speed. For example, a modification to the embodiment of FIG. 2 is shown in FIG. 6 wherein the photoconductive material 44 of the photoconductive drum 25 and the dielectric sheet 26 of the transfer drum 24 are replaced with a photoconductive belt 44A and a dielectric sheet 26A in the form of an endless belt, respectively.

Various modifications will become possible for those skilled in the art after receiving the teachings of the present disclosure without departing from the scope thereof.

What is claimed is:

1. A device for positioning relative to each other a first and a second body which are movably driven independently of each other, comprising:

a base constituting said first body;

a first contact surface member provided on a part of said base;

a frame constituting said second body and having an opening formed therethrough; and a second contact surface member provided on and supported by a part of said frame and closing said opening, said second contact surface member making contact with said first contact surface member;

said first contact surface member having a width in a direction perpendicular to a driven direction of movement of said first body which is smaller than a width of said opening of said frame in a direction perpendicular to a driven direction of movement of said second body.

2. A device as claimed in claim 1, further comprising means for maintaining a constant distance between said first and second bodies.

3. A device as claimed in claim 2, wherein said means for maintaining a constant distance comprises a part of said base other than that in which said first contact surface member is provided, and a part of said frame other than that in which said second contact surface member is provided, said other part of said frame making direct contact with said other part of said base.

4. A device as claimed in claim 3, wherein said first and second contact surface members comprise a rigid member and a flexible member, respectively.

5. A device as claimed in claim 4, wherein said rigid and flexible members comprise a photoconductive material and a dielectric sheet member, respectively.

6. A device as claimed in claim 5, wherein said dielectric sheet member comprises a film of polyester.

7. A device as claimed in claim 5, wherein said dielectric sheet member comprises a film of 4-vinylidene flouride.

8. A device as claimed in claim 1, wherein each of said first and second bodies comprise a movable belt.

9. A device as claimed in claim 1, wherein each of said first and second bodies comprises a rotatable drum.

10. A device for positioning relative to each other a first and a second body which are rotatably driven independently of each other, comprising:

a base in the form of a drum constituting said first body and being rotatably mounted on a shaft;

a first contact surface member wrapped around said base;

a hollow cylindrical frame constituting said second body and having an intermediate opening formed therethrough and being rotatably mounted on a shaft; and a second contact surface member wrapped around and supported by said frame and closing said intermediate opening, said second contact surface member making contact with said first contact surface member, said first contact surface member having an axial width which is smaller than an axial width of said intermediate opening of said frame.

11. A device as claimed in claim 10, further comprising means for maintaining a constant distance between said first and second bodies.

12. A device as claimed in claim 11, wherein said means for maintaining a constant distance comprises positioning disks each being rotatable about said shaft upon which said drum is mounted at a respective one of opposite ends of said base with respect to an axial direction of said drum, and rotatable rings constituting opposite ends of said frame and each making direct rolling contact with a respective one of said positioning disks.

13. A device as claimed in claim 12, wherein said frame is comprised by said rotatable rings and a connecting portion which extends parallel to an axis of said frame to interconnect said rotatable rings.

14. A device as claimed in claim 13, wherein said intermediate opening is defined by said rotatable rings and said connecting portion.

15. A device as claimed in claim 13, wherein a leading end of said second contact surface member is fixed to said connecting portion.

16. A device as claimed in claim 15, wherein a trailing end of said second contact surface member is fixed to said connecting portion.

17. A device as claimed in claim 16, wherein opposite side edges of said second contact surface member are individually supported by said rotatable rings.

18. A device as claimed in claim 17, wherein in an edge portion of each said rotatable ring adjacent to said intermediate opening is formed with a stepped portion for allowing said second contact surface member to yield thereinto.

19. A device as claimed in claim 18, wherein said width of said intermediate opening of said frame including widths of said stepped portions is greater than said width of said first contact surface member.

20. A device as claimed in claim 10, wherein said first and second contact surface member comprise a rigid member and a flexible member, respectively.

21. A device as claimed in claim 20, wherein said rigid and flexible members comprise a photoconductive member and a dielectric sheet member, respectively.

22. A device as claimed in claim 21, wherein said dielectric sheet member comprises a film of polyester.

23. A device as claimed in claim 21, wherein said dielectric sheet member comprises a film of 4-vinylidene fluoride.

24. An image forming apparatus for recording an image on a paper sheet, said image forming apparatus having at least photoconduction means and image transfer means, each being in the form of a drum and being rotatable independently of the other, said photoconductive means and image transfer means comprising:

a base in the form of a drum constituting said photoconduction means and being rotatably mounted on a shaft;

a photoconductive material wrapped around said base;

a hollow cylindrical frame constituting said transfer means and having an intermediate opening formed therethrough and being rotatably mounted on a shaft; and a dielectric sheet member wrapped around and supported by said frame and closing said intermediate opening, said dielectric sheet member functioning as a transfer member which makes contact with said dielectric material, said photoconductive material having an axial width which is smaller than an axial width of said intermediate opening of said frame.

25. An apparatus as claimed in claim 24, further comprising means for maintaining a constant distance between said photoconduction and transfer means.

26. An apparatus as claimed in claim 25, wherein said means for maintaining a constant distance comprises two positioning disks each being rotatable about said shaft upon which said shaft is mounted at a respective one of opposite ends of said drum with respect to an axial direction of said drum, and two rotatable rings each comprising a respective one of opposite ends of said frame and making direct rolling contact with a respective one of said positioning disks.

27. An apparatus as claimed in claim 26, wherein said frame is comprised by said rotatable rings and a connecting portion which extends parallel to an axis of said frame to interconnect said rotatable rings.

28. An apparatus as claimed in claim 27, wherein said intermediate opening is defined by said rotatable rings and said connecting portion.

29. An apparatus as claimed in claim 28, wherein a leading end of said dielectric sheet member is fixed to said connecting portion of said frame.

30. An apparatus as claimed in claim 29, wherein a trailing end of said dielectric sheet member is fixed to said connecting portion of said frame.

31. An apparatus as claimed in claim 30, wherein opposite side edges of said dielectric sheet member are supported by said rotatable rings.

32. An apparatus as claimed in claim 31, wherein an edge portion of each said rotatable ring adjacent to said intermediate opening is formed with a stepped portion for allowing said dielectric sheet member to yield thereinto.

33. An apparatus as claimed in claim 32, wherein said width of said intermediate opening of said frame which is greater than said width of said photoconductive material includes widths of said stepped portions.

34. An apparatus as claimed in claim 24, wherein said dielectric sheet member comprises a film of polyester.

35. An apparatus as claimed in claim 24, wherein said dielectric sheet member comprises a film of 4-vinylidene flouride.

* * * * *